US011572763B2

(12) United States Patent
Seet

(10) Patent No.: US 11,572,763 B2
(45) Date of Patent: Feb. 7, 2023

(54) COLLAPSIBLE BULLNOSE ASSEMBLY FOR MULTILATERAL WELL

(71) Applicant: Halliburton Energy Services, Inc., Houston, TX (US)

(72) Inventor: Shu Yi Dione Seet, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/346,909

(22) Filed: Jun. 14, 2021

(65) Prior Publication Data

US 2022/0170345 A1 Jun. 2, 2022

Related U.S. Application Data

(60) Provisional application No. 63/120,058, filed on Dec. 1, 2020.

(51) Int. Cl.
*E21B 41/00* (2006.01)
*E21B 7/06* (2006.01)

(52) U.S. Cl.
CPC ..... *E21B 41/0035* (2013.01); *E21B 7/061* (2013.01)

(58) Field of Classification Search
CPC ..... E21B 7/061; E21B 47/0035
See application file for complete search history.

(56) References Cited

U.S. PATENT DOCUMENTS 8,985,203 B2 3/2015 Stokes et al.
9,243,465 B2 1/2016 Lajesic
9,260,945 B2 2/2016 Lajesic et al.
9,284,802 B2 3/2016 Stokes
2010/0163240 A1 7/2010 Ingraham et al.
2016/0245046 A1* 8/2016 Butler ..... E21B 23/12
2018/0112497 A1* 4/2018 Pendleton ..... E21B 41/0035

FOREIGN PATENT DOCUMENTS

AU 2016386404 A1 * 5/2018 ..... E21B 33/1216
WO 2015-012845 1/2015
WO 2015-030842 3/2015
WO 2019-094048 5/2019

OTHER PUBLICATIONS

International Search Report and Written Opinion for Application No. PCT/US2021/038701, dated Oct. 19, 2021.

* cited by examiner

*Primary Examiner* — Christopher J Sebesta
*Assistant Examiner* — Lamia Quaim
(74) *Attorney, Agent, or Firm* — Scott Richardson; C. Tumey Law Group PLLC

(57) ABSTRACT

A collapsible bullnose assembly may include a mandrel, a bullnose secured to a distal end of the mandrel, a lower ramp disposed about the mandrel adjacent the bullnose and having a first ramped surface, and an upper ramp slidably disposed around and releasably secured to the mandrel. The upper ramp may have a second ramped surface axially offset from the first ramped surface. The collapsible bullnose assembly may further include a collapsible guide member having opposing ends initially supported on the first and second ramped surfaces and protruding radially outwardly of the bullnose. The collapsible guide member may be actuatable to a radially collapsed orientation in response to axially shifting the upper ramp along the mandrel to a released position away from the lower ramp.

18 Claims, 5 Drawing Sheets

COLLAPSIBLE BULLNOSE ASSEMBLY FOR MULTILATERAL WELL

CROSS-REFERENCE TO RELATED APPLICATION

The present application claims the benefit of U.S. Provisional Application No. 63/120,058, entitled "COLLAPSIBLE BULLNOSE ASSEMBLY FOR MULTILATERAL WELL" and filed Dec. 1, 2020, the disclosure of which is incorporated herein by reference for all purposes.

BACKGROUND

Intelligent well completion systems are used to remotely control and monitor reservoir zones in a well. Generally intelligent well completion systems include valves, sensors, as well as other features, configured to provide flow control within the well. Traditionally, feeding these components into a lateral leg of a multi-lateral wells may require a shearable shroud to help divert a bullnose assembly into a lateral leg. However, using a shroud may damage internal control valves, swellpackers, and/or control lines when passing through the shroud, which may lead to loss of communication to the internal control valves. Additionally, the internal control valves may be required to run in an opened position, which will not allow for any hydraulic activated mechanism to expand the bullnose such that that the bullnose requires a mechanically activated feature to expand.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for installing portions of an intelligent completion system in a lateral wellbore of a multi-lateral well. In particular, disclosed herein is a collapsible bullnose assembly that is run-in-hole in a radially expanded orientation having a sufficiently large outside diameter to deflect off of a deflector assembly and into the lateral wellbore, and then transition to a radially collapsed orientation at a lateral liner disposed within the lateral wellbore. The radially collapsed orientation may have a sufficiently small outer diameter such that the collapsible bullnose assembly may travel into the lateral top liner.

Figure 1:
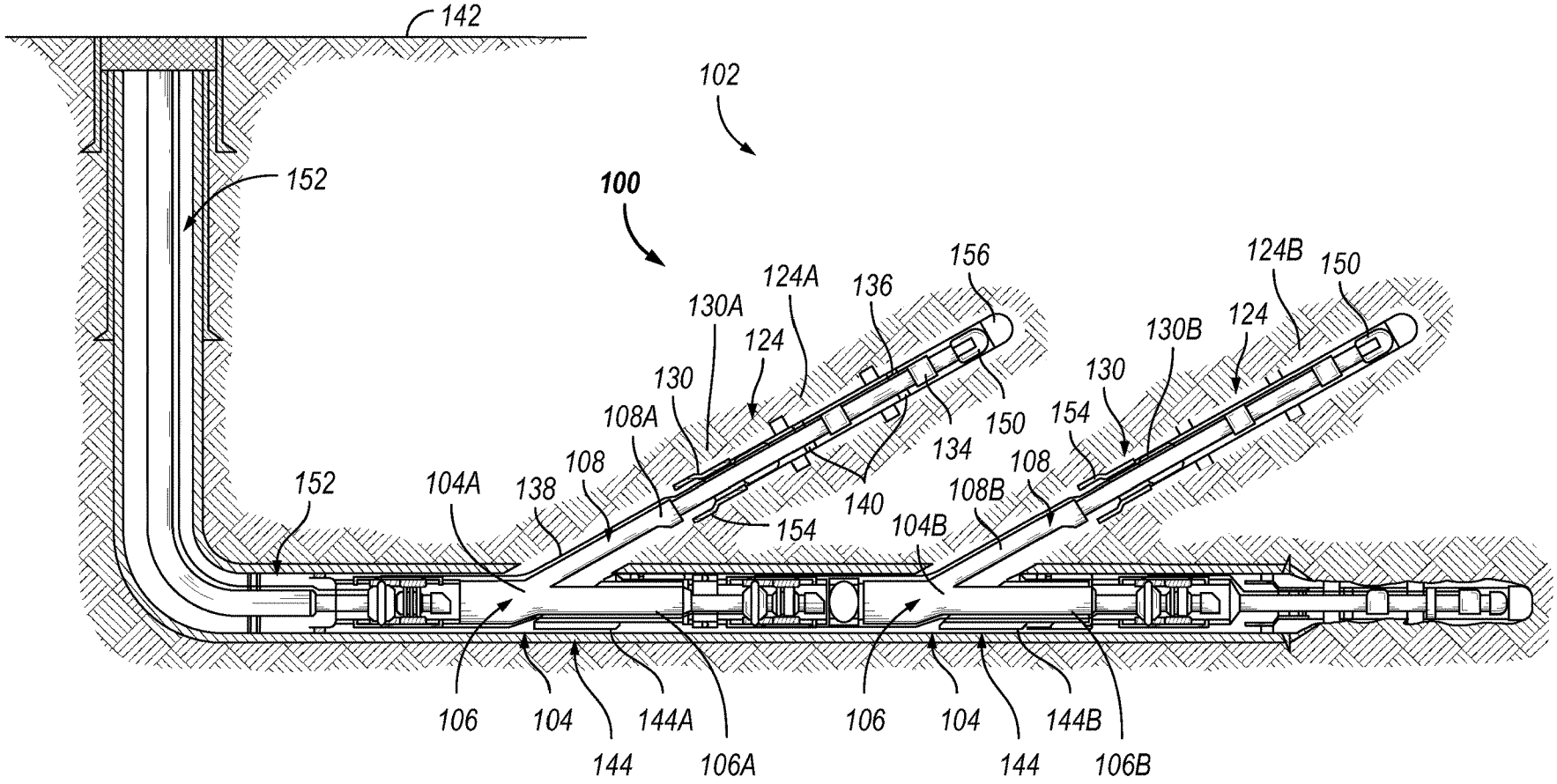
FIG. 1 illustrates an elevation view of a completion system in a multilateral wellbore, in accordance with some embodiments of the present disclosure.

FIG. 1 illustrates an elevation view of a completion system 100 for transferring power and communication signals in a multilateral wellbore 102, in accordance with some embodiments of the present disclosure. The multilateral wellbore 102 includes a plurality of lateral wellbores 124 (e.g., upper lateral wellbore 124A and lower lateral wellbore 124B), each of which branch off from a same main wellbore 152, which is drilled from surface 142. In some embodiments, a lateral wellbore may itself branch off from another lateral wellbore 124, and not necessarily from a main wellbore 152. For example, the lateral wellbore 124B may branch off from the lateral wellbore 124A instead of from the main wellbore 152. Generally, the completion system 100 includes at least one multilateral junction 104, with a main leg 106 and a lateral leg 108, to reinforce the multilateral wellbore 102 where the at least one lateral wellbore 124 intersects the main wellbore 152. In particular, the main leg 106 may reinforce the main wellbore 152 at that intersection and the lateral leg 108 may reinforce the lateral wellbore 124 at that intersection. In the illustrated embodiment, the completion system 100 includes an upper multilateral junction 104A and a lower multilateral junction 104B to reinforce the main wellbore 152 and the respective upper and lower lateral wellbores 124A and 124B. However, the completion system 100 may include any number of multilateral junctions 104A. Further, each main leg 106 (e.g., upper main leg 106A and lower main leg 106B) of the respective multilateral junctions 104A, 104B may be configured to couple with a corresponding component to provide power and/or communication transfer. For example, in the illustrated embodiment, the upper main leg 106A of the upper multilateral junction 104A may be configured to couple with the corresponding lower multilateral junction 104B to provide power and/or communication transfer between the upper multilateral junction 104A and the corresponding lower multilateral junction 104B.

Moreover, each lateral leg 108 (e.g., upper lateral leg 108A and lower lateral leg 108B) of the respective multilateral junctions 104A, 104B is configured to be deflected into a corresponding lateral wellbore 124A, 124B and run into a corresponding lateral liner 130 (e.g., upper lateral liner 130A and lower lateral liner 130B). For example, the upper lateral leg 108A of the upper multilateral junction 104A may be configured to run into the upper lateral liner 130A of the completion system 100 disposed in the upper lateral wellbore 124A, and the lower lateral leg 108B of the lower multilateral junction 104B may be configured to run into the lower lateral liner 130B of the completion system 100 disposed in the lower lateral wellbore 124B.

Each lateral liner 130A, 130B may include a plurality of control and sensor devices 134 (including a plurality of internal control valves 140). For example, in the illustrated embodiment, the upper lateral leg 108A may be configured to couple wiring 136 (e.g., an upper umbilical 138) to corresponding wiring of the upper lateral liner 130 to at least provide power and communication signals to the plurality of internal control valves 140. In some embodiments, the communication signals may be sent from the surface 142 via the wiring 136 to control operation of the plurality of internal control valves 140. Communication signals may also be sent from the control and sensor devices 134, via the wiring 136, to the surface 142. As such, the wired connection may allow the surface 142 to remotely control plurality of control and sensor devices 134 of the upper lateral liner 130A and monitor reservoir zones disposed proximate the upper lateral wellbore 124A, as well as other portions of the completion system 100.

Moreover, the completion system 100 may include at least one deflector assembly 144. In the illustrated embodiment, the completion system 100 includes an upper deflector assembly 144A and a lower deflector assembly 144B. Each deflector assembly 144A, 144B may be disposed directly downhole from a corresponding lateral wellbore 124A or 124B. Further, each deflector assembly 144A, 144B may be configured to deflect tools of the completion system 100 (e.g., a collapsible bullnose assembly 150) away from the main wellbore 152 of the multilateral wellbore 102 and into the corresponding lateral wellbore 124A or 124B. For example, the collapsible bullnose assembly 150 of the upper lateral leg 108A is configured to run into (e.g., enter) the corresponding upper lateral liner 130A via a respective top portion 154 of the upper lateral liner 130A. The collapsible bullnose assembly 150 is configured to run past the top portion 154 of the upper lateral liner 130A, through upper lateral liner 130A, and to an end of the upper lateral liner 130A (e.g., screen liner bullnose 156) such that at least a portion of the upper lateral leg 108A is positioned within the upper lateral liner 130A. In some embodiments, the upper lateral leg 108A may couple to the upper lateral liner 130A (e.g., to provide power and/or communication) with the collapsible bullnose assembly 150 positioned at the end of the upper lateral liner 130A.

Figure 2:
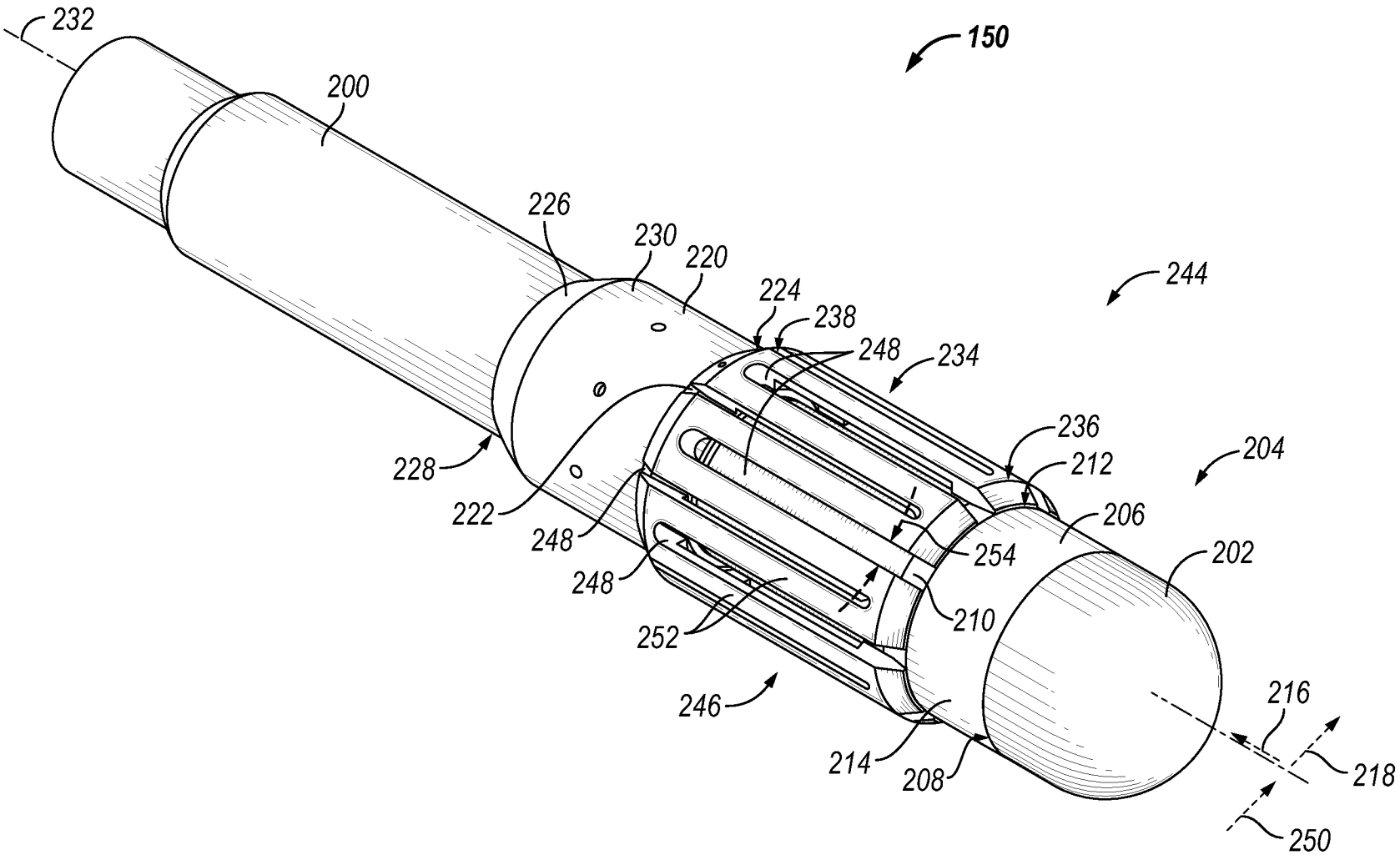
FIG. 2 illustrates a perspective view of a collapsible bullnose assembly, in accordance with one or more embodiments.

FIG. 2 illustrates a perspective view of a specific example configuration of a collapsible bullnose assembly 150, in accordance with one or more embodiments. As illustrated, the collapsible bullnose assembly 150 includes a mandrel 200 having a bullnose 202 secured to a distal end 204 of the mandrel 200. Moreover, the collapsible bullnose assembly 150 has a lower ramp 206 disposed about the mandrel 200 adjacent the bullnose 202. A distal end 208 of the lower ramp 206 contacts a proximal end of the bullnose. The lower ramp 206 has a first ramped surface 210 (e.g., angled portion) at a proximal end 212 of the lower ramp 206 that slopes down from an outer surface 214 of the lower ramp 206 to the mandrel 200 in an axially uphole direction 216. As such, the first ramped surface 210 faces in a radially outward direction 218. The collapsible bullnose assembly 150 also includes an upper ramp 220 slidably disposed about and releasably secured to the mandrel 200. The upper ramp 220 has a second ramped surface 222 at a distal end 224 of the upper ramp 220 and a third ramped surface 226 at a proximal end 228 of the upper ramp 220. The second ramped surface 222 and the third ramped surface 226 each slope down from an outer surface 230 of the upper ramp 220 to the mandrel 200 such that the second ramped surface 222 and the third ramped surface 226 each face in the radially outward direction 218. Further, the upper ramp 220 is axially offset from the lower ramp 206 along a central axis 232 of the collapsible bullnose assembly 150. That is, the second ramped surface 222 is axially offset from the first ramped surface 210 of the lower ramp 206. Other specific configuration and arrangement of these various ramped surfaces and other features are possible within the scope of this disclosure.

The collapsible bullnose assembly 150 may further include a collapsible guide member 234. Opposing ends (e.g., distal end 236 and proximal end 238) of the collapsible guide member 234 may be supported by the first ramped surface 210 and the second ramped surface 222, respectively. In a secured position 244 of the upper ramp 220, the collapsible guide member 234 may be secured to the upper ramp 220 via at least one first shear member 240. In particular, the proximal end 238 of the collapsible guide member 234 may be secured to the upper ramp 220 via the at least one first shear member 240. Moreover, the upper ramp 220 may be releasably secured to the mandrel 200 in the secured position 244 via at least one second shear member 242. The at least one first and second shear members 240, 242 may include any suitable fastener (e.g., pin, screw, etc.) configured to shear in response to sufficient axial force on the upper ramp 220. The upper ramp 220 may slide axially along the mandrel 200 from a secured position 244 to a released position (shown in FIG. 4B) in response to the at least one first and second shear members 240, 242 being sheared. In some embodiments, the at least one second shear member 242 may have a higher shear strength than the at least one first shear member 240 such that the at least one first shear member 240 may shear at the same time or before the at least one second shear member 242. In the illustrated embodiment, a plurality of second shear members 242 may secure the upper ramp 220 to the mandrel 200 in the secured position 244. Further, a plurality of first shear members 240 may secure the collapsible guide member 234 to the upper ramp 220.

The collapsible guide member 234 is configured to expand and/or contract between a radially expanded orientation 246 and a radially collapsed orientation (shown in FIG. B) based at least in part on a relative axial position of the upper ramp 220 with respect to the lower ramp 206. For example, in the secured position 244, the collapsible guide member 234 may be in the radially expanded orientation 246. However, the collapsible bullnose assembly 150 may actuate to the radially collapsed orientation in response to the upper ramp 220 sliding axially along the mandrel 200, in a direction away from the lower ramp 206 (e.g., the axially uphole direction 216), from the secured position 244 to the released position.

The collapsible guide member 234 has a substantially hollow, cylindrical shape that may be disposed around the mandrel 200. As set forth above, collapsible guide member 234 is configured to expand and/or contract between a radially expanded orientation 246 and a radially collapsed orientation (shown in FIG. 4B). In the illustrated embodiment, the collapsible guide member 234 is in the radially expanded orientation 246. In some embodiments, the collapsible guide member 234 includes a plurality of slots 248 configured to allow the collapsible guide member 234 to expand radially outward 218 and collapse radially inward 250 with respect to the mandrel 200. The plurality of slots 248 may provide space for adjacent body portions 252 of the collapsible guide member 234 to move into when contracting to the radially collapsed orientation. The plurality of slots 248 may be disposed around a circumference of the collapsible guide member 234. Further, each slots of the plurality of slots 248 may extend through a radial width of the collapsible guide member 234 and extending along the axial direction with respect to the mandrel 200. Based on the positioning of the plurality of slots 248, the collapsible guide member 234 may have a substantially serpentine shape. Adjacent slots of the plurality of slots 248 extend through opposite axial ends (e.g., the distal end 236 and the proximal end 238) of the collapsible guide member 234.

A current width 254 of each slot 248 of the plurality of slots 248 may be based at least in part on a radial orientation of the collapsible guide member 234. Each slot 248 has a maximum width in the radially expanded orientation 246 (e.g., fully expanded). As the collapsible guide member 234 actuates from the radially expanded orientation 246 to the radially collapsed orientation, the current width 254 of each slot 248 of the plurality of slots 248 decreases. Each slot 248 has a minimum width in the radially collapsed orientation (e.g., fully collapsed). Further, in some embodiments, the minimum and/or maximum widths of each slot 248 of the plurality of slots 248 may limit contraction and expansion of the collapsible guide feature. For example, in the radially collapsed orientation, the widths of the slots 248 may become sufficiently small (e.g., at the minimum width) that adjacent body portions 252 of the collapsible guide member 234 contact each other and prevent further contraction of the collapsible guide member 234. As such, a total radial travel distance of a radially outer surface 258 of the collapsible guide member 234 between the radially expanded orientation 246 and the radially collapsed orientation may be based at least in part on the minimum and/or maximum widths of each slot 248 of the plurality of slots 248.

Figure 3A:
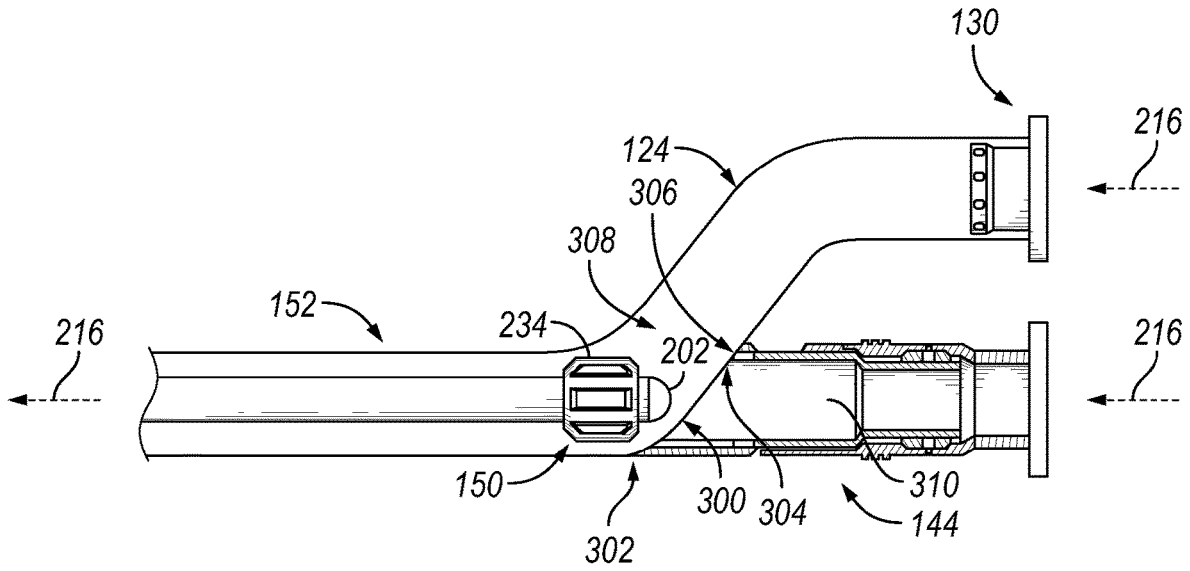
FIGS. 3A and 3B illustrate cross sectional views of the collapsible bullnose assembly at the deflector face and at the lateral liner top, respectively, in accordance with one or more embodiments.
Figure 3B:
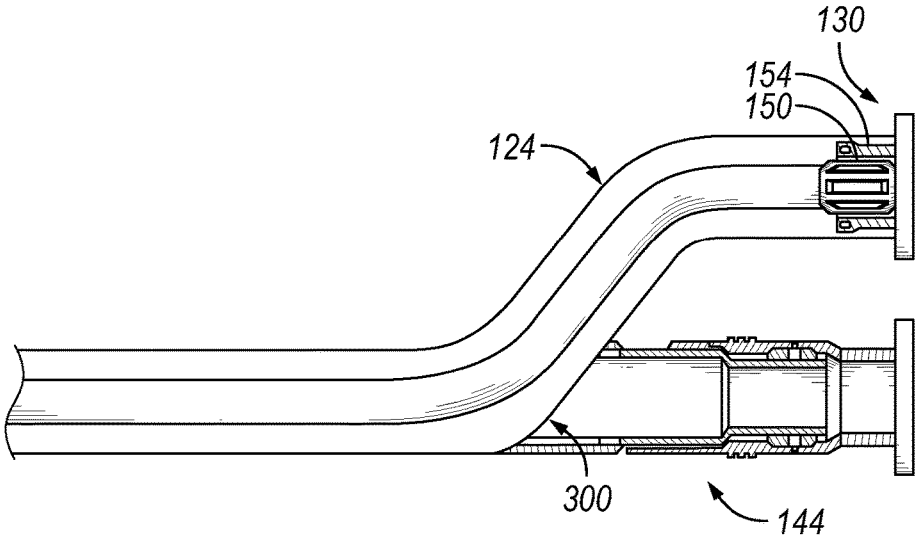

FIGS. 3A and 3B illustrate cross sectional views of the collapsible bullnose assembly 150 at a deflector face 300 of the deflector assembly 144 and at the lateral liner 130, respectively, in accordance with one or more embodiments. Referring to FIG. 3A, the deflector assembly 144 is positioned within the main wellbore 152 of the multi-lateral wellbore 102 in a position downhole from a corresponding lateral wellbore 124. The deflector assembly 144 has a deflector face 300 angled toward the lateral wellbore 124. That is, the deflector face 300 may slope down from an upper side 302 to a lower side 304 of the deflector face 300. In the illustrated embodiment, the lower side 304 of the deflector face 300 is disposed proximate a lower edge 306 of an opening 308 to the lateral wellbore 124. The upper side 302 of the deflector face 300 may be disposed uphole (e.g., in the axially uphole direction 216) from the lower side 304 of the deflector face 300. The deflector face 300 may include an axial bore 310 configured to receive the main leg 106 of the multilateral junction 104 (shown in FIG. 1). As such, the axial bore has a diameter greater than an outer diameter of the main leg of the multilateral junction.

The lateral leg 108 may include the collapsible bullnose assembly 150 with an outer diameter greater than the diameter of the axial bore 310 such that collapsible bullnose assembly 150 is prevented from entering the axial bore 310 and is instead directed, via the deflector assembly 144, into the lateral wellbore 124. The slope of the deflector face 300 may help guide the collapsible bullnose assembly 150 into the lateral wellbore 124. In particular, the bullnose 202 and/or the collapsible guide member 234 may have an outer diameter greater than the diameter of the axial bore 310. In some embodiments, an outer diameter of the collapsible guide member 234 in the radially expanded orientation 246 may be greater than an outer diameter of the bullnose 202, and only the outer diameter of the collapsible guide member 234 in the radially expanded orientation 246 may be greater than the diameter of the axial bore 310. In such embodiments, the collapsible guide member 234 may interface with the deflector face 300 to cause the collapsible bullnose assembly 150 to travel up the deflector face 300 and deflect into the lateral wellbore 124.

Referring to FIG. 3B, the collapsible bullnose assembly 150 is deflected into a portion of the lateral wellbore 124. In the illustrated embodiment, the collapsible bullnose assembly 150 has partially entered into the top portion 154 of a lateral liner 130. The collapsible bullnose assembly 150 is configured to actuate from the radially expanded orientation 246 to the radially collapsed orientation (shown in FIG. 4B) to enter the lateral liner 130 and pass through the top portion 154 of the lateral liner 130.

Figure 4A:
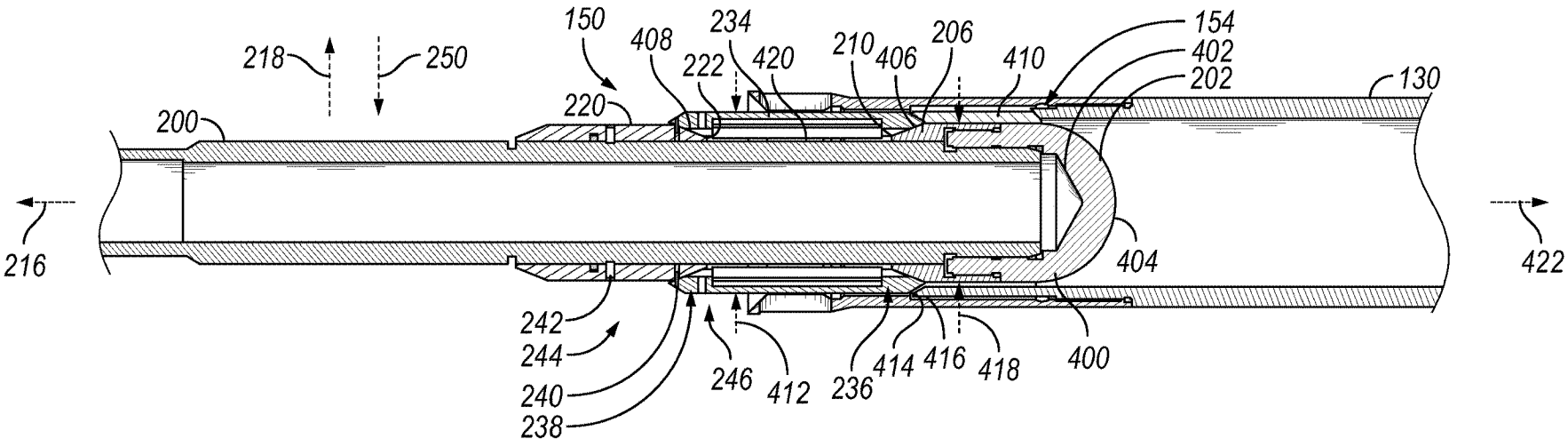
FIGS. 4A and 4B illustrate cross sectional views of the collapsible guide member of the collapsible bullnose assembly in the radially expanded orientation and the radially collapsed orientation, respectively, in accordance with one or more embodiments.
Figure 4B:
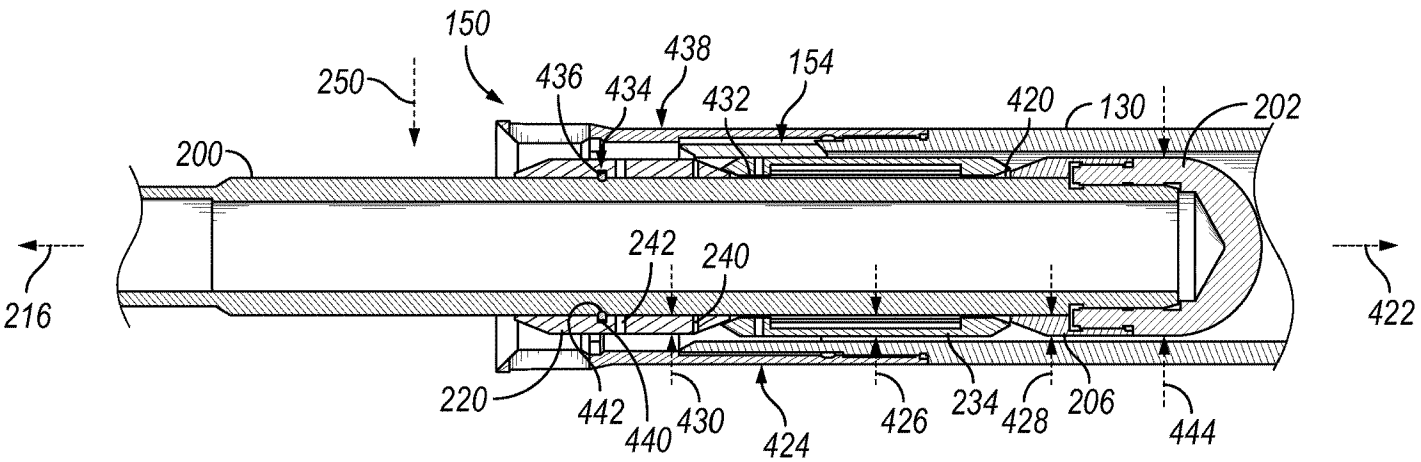

FIGS. 4A and 4B illustrate cross sectional views of the collapsible guide member 234 of the collapsible bullnose assembly 150 in the radially expanded orientation 246 and the radially collapsed orientation, respectively, in accordance with one or more embodiments. Referring to FIG. 4A, the collapsible bullnose assembly 150 includes the bullnose 202 as set forth above. The bullnose 202 may include an annular body 400 having a closed tip 402. The close tip 402 of the bullnose 202 may have a rounded exterior surface 404. Further, the bullnose 202 may be disposed at least partially around the mandrel 200 such that the bullnose 202 extends radially outward 218 from the mandrel 200.

The collapsible bullnose assembly 150 also includes the lower ramp 206 and the upper ramp 220 disposed about the mandrel 200. In some embodiments, the ramped surfaces 206, 220 may have a substantially constant slope angles such that the ramped surfaces 206, 220 are planar. However, the ramped surfaces 206, 220 may include variable slope angles. In the illustrated embodiment, the upper ramp 220 is disposed in the secured position 244 to hold the collapsible guide member 234 in the radially expanded orientation 246. As set forth above, the distal end 236 and the proximal end 238 of the collapsible guide member 234 may be supported by the first ramped surface 210 of the lower ramp 206 and the second ramped surface 222 of the upper ramp 220, respectively. In particular, the collapsible guide member 234 comprises a fourth ramped surface 406 at the distal end 236 and a fifth ramped surface 408 at the proximal end 238 of the collapsible guide member 234 that are supported by and configured to slide along the first ramped surface 210 and the second ramped surface 222, respectively. For example, as the upper ramp 220 moves axially toward the released position, the fourth ramped surface 406 may slide down the first ramped surface 210 toward the mandrel 200, thereby actuating the collapsible guide member 234 radially inward 250 from the radially expanded orientation 246 toward the radially collapsed orientation. Similarly, as the upper ramp 220 moves axially toward the released position, the fifth ramped surface 408 may slide down the second ramped surface 222 toward the mandrel 200, thereby actuating the collapsible guide member 234 radially inward 250 from the radially expanded orientation 246 toward the radially collapsed orientation.

In the illustrated embodiment, the upper ramp 220 is held is the secured position 244, via the at least one first shear member 240 and the at least one second shear member 242, which prevents the collapsible guide member 234 from actuating radially inward 250 toward the radially collapsed orientation. Specifically, the collapsible guide member 234 is secured to the upper ramp 220 via the at least one first shear member 240, and the upper ramp 220 is releasably secured to the mandrel 200 via the at least one second shear member 242. Thus, to transition the collapsible guide member 234 from the radially expanded orientation 246 to the radially collapsed orientation, the collapsible bullnose assembly 150 is configured to shear the at least one first shear member 240 and the at least one second shear member 242 such that the upper ramp 220 may slide axially away from the lower ramp 206 and the collapsible guide member 234 may slide down the first 210 and second ramped surface 222 toward the radially collapsed orientation. In some embodiments, the collapsible bullnose assembly 150 may be driven into the lateral liner 130 to shear the at least one first shear member 240 and the at least one second shear member 242.

In the illustrated embodiment, the collapsible guide member 234 is in contact with a no-go shoulder 410 of the top portion 154 of the lateral liner 130. Indeed, a first outer diameter 412 of the collapsible guide member 234 in the radially expanded orientation 246 is greater than an inner diameter 418 of the no-go shoulder 410 of the lateral liner 130 such that the collapsible guide member 234 may contact the no-go shoulder 410 of the top portion 154 of the lateral liner 130 in the radially expanded orientation 246. Specifically, at least one radially outwardly facing ramped surface 414 of the collapsible guide member 234 may interface with an inwardly facing ramped surface 416 of the no-go shoulder 410 in response to the axial engagement of the collapsible guide member 234 against the no-go shoulder 410 of the lateral liner 130. The inwardly facing ramped surface of the no-go shoulder 410 defined by the inner diameter 418 of the no-go shoulder 410 of the lateral liner 130.

Contact between the no-go shoulder 410 and the collapsible guide member 234 may prevent the collapsible bullnose assembly 150 from traveling through the top portion 154 and into the lateral liner 130. To continue traveling into the lateral liner 130 in the downhole direction 422, the collapsible guide member 234 may transition from the radially expanded orientation 246 to the radially collapsed orientation. In the radially collapsed orientation, a second outer diameter of the collapsible bullnose assembly 150, which is smaller than the first outer diameter 412, may be less than the inner diameter 418 of the no-go shoulder 410 of the lateral liner 130. Thus, to allow the collapsible bullnose assembly 150 to travel through the top portion 154 and into the lateral liner 130, the collapsible bullnose assembly 150 may be driven into the no-go shoulder 410 of the lateral liner 130 to shear the at least one first shear member 240 and the at least one second shear member 242 such that the collapsible guide member 234 transitions from the radially expanded orientation 246 to the radially collapsed orientation.

Driving the collapsible bullnose assembly 150 into the lateral liner 130 may generate a driving force on the collapsible guide member 234 in the axially uphole direction 216. The driving force may shear the at least one first shear member 240 holding the collapsible guide member 234 to the upper ramp 220. As the upper ramp 220 is still secured to the mandrel 200 via the at least one second shear member 242, the driving force on the collapsible guide member 234 may cause the collapsible guide member 234 to move in the radially outward direction 218. That is, the driving force may cause the collapsible guide member 234 to slide up the second ramped surface 222 in the radially outward direction 218. However, the inner diameter 418 of the no-go shoulder 410 of the lateral liner 130 may constrain radially outward movement of the collapsible guide member 234, thereby, preventing the collapsible guide member 234 from moving radially outward out of an axial gap 420 between the upper and lower ramps 206, 220. As such, at least a portion of the collapsible guide member 234 may be axially aligned with the upper ramp 220. Thus, the collapsible guide member 234 may be constrained from moving in a downhole direction 422 by the no-go shoulder 410 of the lateral liner 130, constrained from moving in the radially outward direction 218 by the inner diameter 418 of the no-go shoulder 410 of the lateral liner 130, and disposed at least radially partially in the axial gap 420 between the upper ramp 220 and lower ramp 206 such that the upper ramp 220 will be constrained from moving in the downhole direction 422 (i.e., due to contact with the collapsible guide member 234). As the upper ramp 220 is secured to the mandrel 200 via the at least one second shear member 242, the second shear member 242 may shear due to the driving force from the mandrel 200. In response to the at least one second shear member 242 shearing, the upper ramp 220 sliding in the axially uphole direction 216 along the mandrel 200 with respect to the lower ramp 206. When the upper ramp 220 slides in the axially uphole direction 216, the second ramped surface 222 of the upper ramp 220 will no longer force the collapsible guide member 234 in the radially outward direction 218, thereby, allowing the no-go shoulder 410 of the lateral liner 130 to drive the collapsible guide member 234 radially inward 250 along the first and second ramped surfaces 206, 222 toward the radially collapsed orientation.

Referring to FIG. 4B, with the at least one first and second shear members 240, 242 sheared, the upper ramp 220 may slide upwards (e.g., in the axially uphole direction 216), allowing the collapsible guide member 234 to contract radially inward 250 into an enlarged axial gap 420 between the upper ramp 220 and the lower ramp 206 formed by the upper ramp 220 sliding axially away from the lower ramp 206 in the uphole direction 216. In the radially collapsed orientation 424, the collapsible bullnose assembly 150 has the second outer diameter 444. The second outer diameter 444 may be measured at the bullnose 202, the upper ramp 220, and/or the lower ramp 206. In some embodiments, the second outer diameter 4444 may be measured at the collapsible guide member 234 in the radially collapsed orientation 424. Moreover, the second outer diameter 444 in the radially collapsed orientation 424 is smaller than the first outer diameter 412 in the radially expanded orientation 246 (shown in FIG. 4A) such that the collapsible bullnose assembly 150 may pass through the top portion 154 of the lateral liner 130 and travel into the lateral liner 130. Further, a radial width 426 of the collapsible guide member 234 may be less than or equal to a radial width 428 of the lower ramp 206 and/or a radial width 430 of the upper ramp 220. Moreover, a radially inner surface 432 of the collapsible guide member 234 contacts the mandrel 200 in the radially collapsed orientation 424.

In some embodiments, the collapsible guide member 234 may also include an anti-reset feature 434. The anti-reset feature 434 may include a locking member 436 (e.g., snap ring) between the upper ramp 220 and the mandrel 200 to re-secure the upper ramp 220 to the mandrel 200 after shifting/moving axially away from the lower ramp 206. That is, the locking member 436 may lock the upper ramp 220 to the mandrel 200 in the released position 438. The released position 438 may include any suitable position of the upper ramp 220 such that the collapsible guide member 234 may be disposed in the radially collapsed orientation 424. The anti-reset feature 434 may prevent the collapsible guide member 234 from expanding again by preventing the upper ramp 220 from moving in the axially downhole direction 422 to a position (e.g., the secured position 244), relative the lower ramp 206, that would cause the collapsible guide member 234 to expand. The locking member 436 may be disposed in a ramp recess 440 of the upper ramp 220. The mandrel 200 may include a corresponding mandrel recess 442 configured to receive the locking member 436. The locking member 436 may be configured to expand into the corresponding mandrel recess 442 in response to the locking member 436 axially aligning with the corresponding mandrel recess 442. The locking member 436 may be axially aligned with the corresponding mandrel recess 442 during insertion of the collapsible bullnose assembly 150 into the lateral liner 130 as the upper ramp 220 is driven to the released position 438.

Figure 5:
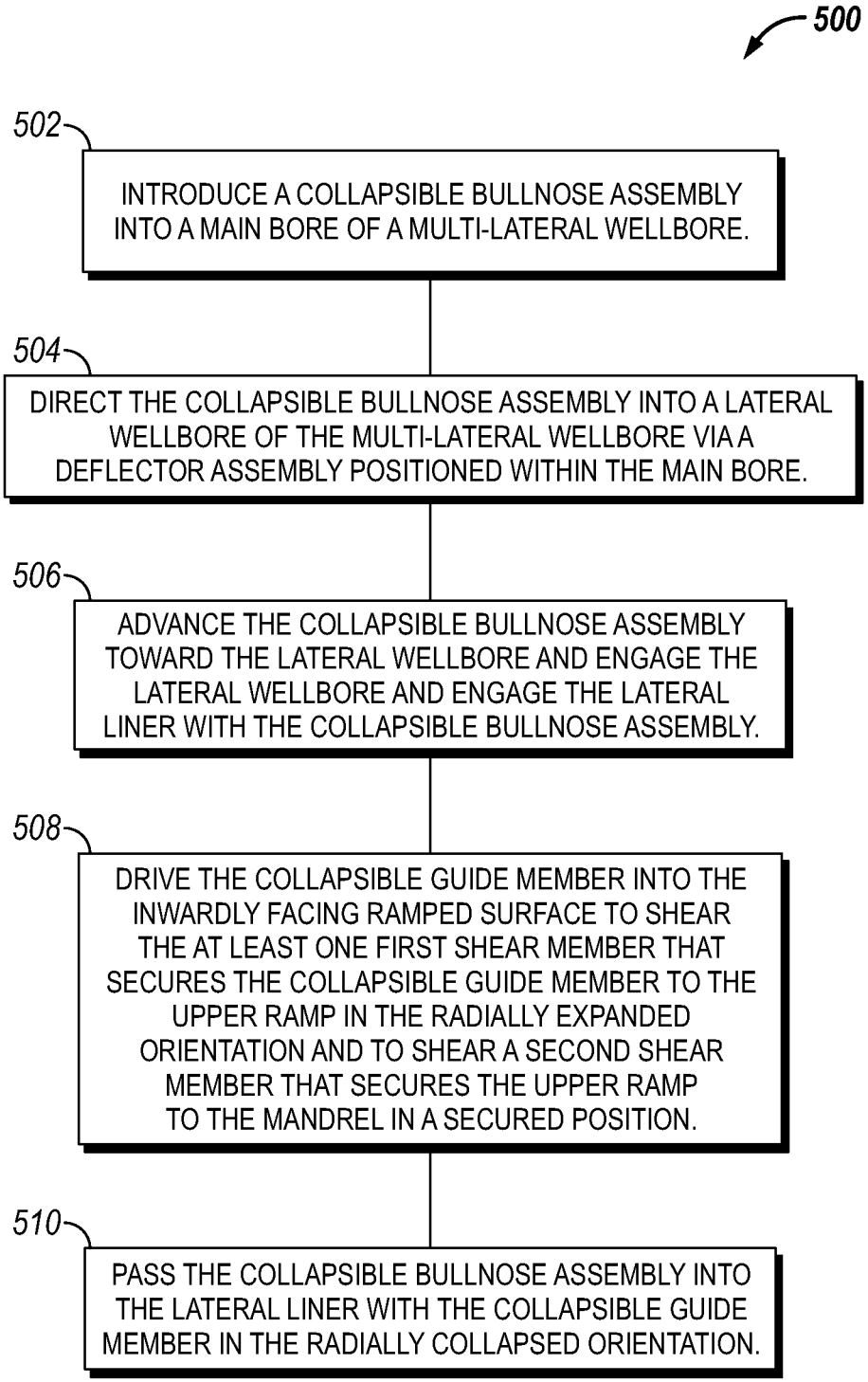
FIG. 5 illustrates a flow chart of a method for running the collapsible bullnose assembly during completion operations, in accordance with one or more embodiments.

FIG. 5 illustrates a flow chart of a method for running the collapsible bullnose assembly during completion operations 500, in accordance with one or more embodiments. The method includes the step 502 of introducing a collapsible bullnose assembly into a main bore of a multi-lateral wellbore. The collapsible bullnose assembly includes the mandrel, the lower ramp disposed about the mandrel and having the first ramped surface, and the upper ramp slidably disposed around and releasably secured to the mandrel. The upper ramp may have the second ramped surface axially offset from the first ramped surface. The collapsible bullnose assembly further includes the collapsible guide member having opposing ends supported on the first and second ramped surfaces. The collapsible guide member is actuatable from a radially expanded orientation to a radially collapsed orientation in response to axially shifting the upper ramp with respect to the lower ramp along the mandrel from a secured position to a released position away from the lower ramp.

Further, the method includes the step 504 of directing the collapsible bullnose assembly into the lateral wellbore of the multilateral wellbore via a deflector assembly positioned within the main bore. As set forth above, the collapsible guide member and/or the bullnose may have a diameter greater than a diameter of an axial bore in the deflector face of the deflector assembly such that the deflector face may cause the collapsible bullnose assembly to slide along the slope of the deflector face and into the lateral wellbore.

Additionally, the method includes the step 506 of advancing the collapsible bullnose assembly toward the lateral liner disposed within the lateral wellbore and engaging the lateral liner with the collapsible bullnose assembly. Contact between the collapsible guide member and the inwardly facing ramped surface defined by the inner diameter of a no-go shoulder of the lateral liner blocks the collapsible bullnose assembly from passing into the lateral liner.

The method includes the step 508 of driving the collapsible guide member into the inwardly facing ramped surface to shear the at least one first shear member that secures the collapsible guide member to the upper ramp in the radially expanded orientation and to shear a second shear member that secures the upper ramp to the mandrel in a secured position. The upper ramp may slide axially uphole to a released position in response to the shearing of the second fastener. As set forth above, the collapsible guide member may be actuated to the radially collapsed orientation in response to the upper ramp sliding to the released position and the shearing of the first fastener.

Moreover, the method includes the step 510 of passing the collapsible bullnose assembly into the lateral liner with the collapsible guide member in the radially collapsed orientation. In the radially collapsed orientation, the outer diameter of the collapsible bullnose assembly may be less than the inner diameter of the no-go shoulder of the top portion of the lateral liner such that the collapsible bullnose assembly may pass through the top portion of the lateral liner and into the lateral liner.

The systems and methods for running and coupling a collapsible bullnose assembly in lateral leg of a multi-lateral well may include any of the various features of the systems and methods disclosed herein, including one or more of the following statements.

Statement 1. A collapsible bullnose assembly may comprise a mandrel; a bullnose secured to a distal end of the mandrel; a lower ramp disposed about the mandrel adjacent the bullnose and having a first ramped surface; an upper ramp slidably disposed about and releasably secured to the mandrel, the upper ramp having a second ramped surface axially offset from the first ramped surface; and a collapsible guide member having opposing ends initially supported on the first and second ramped surfaces and protruding in a radially outward direction with respect to the bullnose, wherein the collapsible guide member is actuatable to a radially collapsed orientation in response to axially shifting the upper ramp along the mandrel to a released position away from the lower ramp.

Statement 2. The collapsible bullnose assembly of statement 1, wherein the upper ramp is moveable to the released position in response to axial engagement of the collapsible guide member against a no-go shoulder of a lateral liner.

Statement 3. The collapsible bullnose assembly of statement 1 or statement 2, wherein the collapsible guide member comprises at least one radially outwardly facing ramped surface configured interface with an inwardly facing ramped surface of the no-go shoulder in response to the axial engagement of the collapsible guide member against a no-go shoulder of a lateral liner.

Statement 4. The collapsible bullnose assembly of any preceding statement, further comprising a first shear member releasably securing the collapsible guide member to the second ramp.

Statement 5. The collapsible bullnose assembly of any preceding statement, further comprising a second shear member releasably securing the second ramp to the mandrel, and wherein the second pin comprises a higher shear strength than the first shear member.

Statement 6. The collapsible bullnose assembly of any preceding statement, further comprising an anti-reset feature including a locking member between the upper ramp and the mandrel to re-secure the upper ramp to the mandrel after shifting away from the lower ramp.

Statement 7. The collapsible bullnose assembly of any preceding statement, wherein the locking member comprises a snap ring positioned in a ramp slot of the upper ramp, and wherein the snap ring expands into a mandrel slot of the mandrel in the released position.

Statement 8. The collapsible bullnose assembly of any preceding statement, wherein the collapsible guide member comprises a plurality of structurally separate slip members circumferentially arranged about the mandrel.

Statement 9. The collapsible bullnose assembly of any preceding statement, wherein the collapsible guide member comprises a third ramped surface and a fourth ramped surface, wherein the third ramped surface slides along the first ramped surface of the lower ramp between the radially expanded orientation and the radially collapsed orientation, and wherein the fourth ramped surface slides along the second ramped surface of the upper ramp between the radially expanded orientation and the radially collapsed orientation.

Statement 10. The collapsible bullnose assembly of any preceding statement, wherein a radially inner surface of the collapsible guide member contacts the mandrel in the radially collapsed orientation.

Statement 11. The collapsible bullnose assembly of any preceding statement, wherein the collapsible guide member comprises a plurality of slots through a radial width of the collapsible guide member, the plurality of slots disposed around a circumference of the collapsible guide member, and each of the plurality of slots extending along an axial direction.

Statement 12. The collapsible bullnose assembly of any preceding statement, wherein the collapsible guide member comprises a serpentine shape having adjacent slots of the plurality of slots extend through opposite axial ends of the collapsible guide member.

Statement 13. The collapsible bullnose assembly of any preceding statement, wherein the collapsible guide member actuates into the radially collapsed orientation for the collapsible bullnose assembly to travel into a lateral liner positioned within a lateral wellbore of a multi-lateral well, wherein the collapsible guide member actuates to the radially collapsed orientation in response to contact with the lateral liner.

Statement 14. The collapsible bullnose assembly of any preceding statement, wherein a radial width of the collapsible guide member is less than or equal to the respective radial widths of the lower ramp and the upper ramp, and wherein a length of the collapsible guide member is longer than the axial gap in the radially expanded orientation.

Statement 15. A multilateral wellbore system may comprise a deflector assembly positioned within a main bore of a multi-lateral well, the deflector assembly comprising a deflector face angled toward a lateral wellbore of the multilateral well; a lateral liner positioned within the lateral wellbore of a multi-lateral well; and a collapsible bullnose assembly directed, via the deflector assembly, into the lateral wellbore and driven to travel into the lateral liner, the collapsible bullnose assembly comprising: a mandrel; a bullnose secured to a distal end of the mandrel; a lower ramp disposed about the mandrel adjacent the bullnose and having a first ramped surface; an upper ramp slidably disposed about and releasably secured to the mandrel, the upper ramp having a second ramped surface axially offset from the first ramped surface, wherein the upper ramp is moveable from a secured position to a released position away from the lower ramp; and a collapsible guide member having opposing ends supported on the first and second ramped surfaces and expanded in a radially expanded orientation in the secured position, wherein the collapsible guide member is actuatable to a radially collapsed orientation in response to axially shifting the upper ramp along the mandrel to the released position, and wherein the collapsible guide member is actuated to the radially collapsed orientation to travel into the lateral liner.

Statement 16. The multilateral wellbore system of statement 15, wherein an outer diameter of the collapsible guide member in the radially expanded orientation is greater than an outer diameter of the bullnose, and wherein the collapsible guide member interfaces with the deflector face in the radially expanded orientation to cause the collapsible bullnose assembly to travel up the deflector face and into the lateral wellbore.

Statement 17. The multilateral wellbore system of statement 15 or statement 16, wherein the collapsible guide member actuates to the radially collapsed orientation in response to contact with an inwardly facing ramped surface defined by an inner diameter of a no-go shoulder of the lateral liner.

Statement 18. The multilateral wellbore system of statements 15-17, wherein the collapsible bullnose assembly comprises a first shear member securing the collapsible guide member to the upper ramp in the secured position and a second shear member securing the upper ramp to the mandrel in the secured position, wherein contact between the collapsible bullnose assembly and the inwardly facing ramped surface of the lateral liner prevents movement of the collapsible guide member in the downhole direction causing the first pin and the second pin to shear and the upper ramp to slide to the released position.

Statement 19. A method for introducing a collapsible bullnose assembly into a main bore of a multi-lateral wellbore, wherein the collapsible bullnose assembly includes a mandrel, a lower ramp disposed about the mandrel and having a first ramped surface, and an upper ramp slidably disposed around and releasably secured to the mandrel, the upper ramp having a second ramped surface axially offset from the first ramped surface, and wherein the collapsible bullnose assembly further includes a collapsible guide member having opposing ends initially supported on the first and second ramped surfaces, and wherein collapsible guide member is actuatable from a radially expanded orientation to a radially collapsed orientation in response to axially shifting the upper ramp with respect to the lower ramp along the mandrel from a secured position to a released position away from the lower ramp; directing the collapsible bullnose assembly into a lateral wellbore of the multilateral wellbore via a deflector assembly positioned within the main bore; advancing the collapsible bullnose assembly toward a lateral liner disposed within the lateral wellbore; engaging the lateral liner with the collapsible bullnose assembly, wherein contact between the collapsible guide member and an inwardly facing ramped surface defined by an inner diameter of a no-go shoulder of the lateral liner blocks the collapsible bullnose assembly from passing into the lateral liner; driving the collapsible guide member into the inwardly facing ramped surface to shear a first shear member that secures the collapsible guide member to the upper ramp in the radially expanded orientation and to shear a second shear member that secures the upper ramp to the mandrel in a secured position, wherein the upper ramp slides axially uphole to a released position in response to the shearing of the second fastener, and wherein the collapsible guide member is actuated to the radially collapsed orientation in response to the upper ramp sliding to the released position and the shearing of the first fastener; and passing the collapsible bullnose assembly into the lateral liner with the collapsible guide member in the radially collapsed orientation.

Statement 20. The method of statement 19, wherein a first outer diameter of the collapsible guide member in the radially expanded orientation is greater than the inner diameter of the no-go shoulder of the lateral liner, and wherein a second outer diameter of the collapsible guide member in the radially collapsed orientation is less than the inner diameter of the no-go shoulder of the lateral liner.

Accordingly, the present disclosure may provide a collapsible bullnose assembly for use in a multilateral wellbore. The present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each are included.

What is claimed is:

1. A collapsible bullnose assembly, comprising:

a mandrel;

a bullnose secured to a distal end of the mandrel;

a lower ramp disposed about the mandrel adjacent the bullnose and having a first ramped surface;

an upper ramp slidably disposed about and releasably secured to the mandrel, the upper ramp having a second ramped surface axially offset from the first ramped surface; and a collapsible guide member having opposing ends initially supported on the first and second ramped surfaces and protruding in a radially outward direction with respect to the bullnose, wherein the collapsible guide member is actuatable to a radially collapsed orientation in response to axially shifting the upper ramp along the mandrel to a released position away from the lower ramp, and wherein the upper ramp is moveable to the released position in response to axial engagement of the collapsible guide member against a no-go shoulder of a lateral liner.

2. The collapsible bullnose assembly of claim 1, wherein the collapsible guide member comprises at least one radially outwardly facing ramped surface configured interface with an inwardly facing ramped surface of the no-go shoulder in response to the axial engagement of the collapsible guide member against a no-go shoulder of a lateral liner.

3. The collapsible bullnose assembly of claim 1, further comprising a first shear member releasably securing the collapsible guide member to the second ramp.

4. The collapsible bullnose assembly of claim 2, further comprising a second shear member releasably securing the second ramp to the mandrel, and wherein a second pin comprises a higher shear strength than the first shear member.

5. The collapsible bullnose assembly of claim 1, further comprising an anti-reset feature including a locking member between the upper ramp and the mandrel to re-secure the upper ramp to the mandrel after shifting away from the lower ramp.

6. The collapsible bullnose assembly of claim 4, wherein a locking member comprises a snap ring positioned in a ramp slot of the upper ramp, and wherein the snap ring expands into a mandrel slot of the mandrel in the released position.

7. The collapsible bullnose assembly of claim 1, wherein the collapsible guide member comprises a plurality of structurally separate slip members circumferentially arranged about the mandrel.

8. A collapsible bullnose assembly, comprising:

a mandrel;

a bullnose secured to a distal end of the mandrel;

a lower ramp disposed about the mandrel adjacent the bullnose and having a first ramped surface;

an upper ramp slidably disposed about and releasably secured to the mandrel, the upper ramp having a second ramped surface axially offset from the first ramped surface; and a collapsible guide member having opposing ends initially supported on the first and second ramped surfaces and protruding in a radially outward direction with respect to the bullnose, wherein the collapsible guide member is actuatable to a radially collapsed orientation in response to axially shifting the upper ramp along the mandrel to a released position away from the lower ramp, and wherein the collapsible guide member comprises a third ramped surface and a fourth ramped surface, wherein the third ramped surface slides along the first ramped surface of the lower ramp between the radially expanded orientation and the radially collapsed orientation, and wherein the fourth ramped surface slides along the second ramped surface of the upper ramp between the radially expanded orientation and the radially collapsed orientation.

9. The collapsible bullnose assembly of claim 1, wherein a radially inner surface of the collapsible guide member contacts the mandrel in the radially collapsed orientation.

10. The collapsible bullnose assembly of claim 1, wherein the collapsible guide member comprises a plurality of slots through a radial width of the collapsible guide member, the plurality of slots disposed around a circumference of the collapsible guide member, and each of the plurality of slots extending along an axial direction.

11. The collapsible bullnose assembly of claim 1, wherein the collapsible guide member comprises a serpentine shape having adjacent slots of the plurality of slots extend through opposite axial ends of the collapsible guide member.

12. The collapsible bullnose assembly of claim 1, wherein the collapsible guide member actuates into the radially collapsed orientation for the collapsible bullnose assembly to travel into a lateral liner positioned within a lateral wellbore of a multi-lateral well, wherein the collapsible guide member actuates to the radially collapsed orientation in response to contact with the lateral liner.

13. The collapsible bullnose assembly of claim 1, wherein a radial width of the collapsible guide member is less than or equal to the respective radial widths of the lower ramp and the upper ramp.

14. A multilateral wellbore system, comprising:

a deflector assembly positioned within a main bore of a multi-lateral well, the deflector assembly comprising a deflector face angled toward a lateral wellbore of the multi-lateral well;

a lateral liner positioned within the lateral wellbore of a multi-lateral well; and a collapsible bullnose assembly directed, via the deflector assembly, into the lateral wellbore and driven to travel into the lateral liner, the collapsible bullnose assembly comprising:

a mandrel;

a bullnose secured to a distal end of the mandrel;

a lower ramp disposed about the mandrel adjacent the bullnose and having a first ramped surface;

an upper ramp slidably disposed about and releasably secured to the mandrel, the upper ramp having a second ramped surface axially offset from the first ramped surface, wherein the upper ramp is moveable from a secured position to a released position away from the lower ramp; and a collapsible guide member having opposing ends supported on the first and second ramped surfaces and expanded in a radially expanded orientation in the secured position, wherein the collapsible guide member is actuatable to a radially collapsed orientation in response to axially shifting the upper ramp along the mandrel to the released position, and wherein the collapsible guide member is actuated to the radially collapsed orientation for the collapsible bullnose assembly to travel into the lateral liner positioned within the lateral wellbore of the multi-lateral well, and wherein the collapsible guide member actuates to the radially collapsed orientation in response to contact with an inwardly facing ramped surface defined by an inner diameter of a no-go shoulder of the lateral liner.

15. The collapsible bullnose assembly of claim 14, wherein an outer diameter of the collapsible guide member in the radially expanded orientation is greater than an outer diameter of the bullnose, and wherein the collapsible guide member interfaces with the deflector face in the radially expanded orientation to cause the collapsible bullnose assembly to travel up the deflector face and into the lateral wellbore.

16. The collapsible bullnose assembly of claim 14, wherein the collapsible bullnose assembly comprises a first shear member securing the collapsible guide member to the upper ramp in the secured position and a second shear member securing the upper ramp to the mandrel in the secured position, wherein contact between the collapsible bullnose assembly and the inwardly facing ramped surface of the lateral liner prevents movement of the collapsible guide member in the downhole direction causing the first pin and the second pin to shear and the upper ramp to slide to the released position.

17. A method, comprising:

introducing a collapsible bullnose assembly into a main bore of a multi-lateral wellbore, wherein the collapsible bullnose assembly includes a mandrel, a lower ramp disposed about the mandrel and having a first ramped surface, and an upper ramp slidably disposed around and releasably secured to the mandrel, the upper ramp having a second ramped surface axially offset from the first ramped surface, and wherein the collapsible bullnose assembly further includes a collapsible guide member having opposing ends initially supported on the first and second ramped surfaces, and wherein collapsible guide member is actuatable from a radially expanded orientation to a radially collapsed orientation in response to axially shifting the upper ramp with respect to the lower ramp along the mandrel from a secured position to a released position away from the lower ramp;

directing the collapsible bullnose assembly into a lateral wellbore of the multilateral wellbore via a deflector assembly positioned within the main bore;

advancing the collapsible bullnose assembly toward a lateral liner disposed within the lateral wellbore;

engaging the lateral liner with the collapsible bullnose assembly, wherein contact between the collapsible guide member and an inwardly facing ramped surface defined by an inner diameter of a no-go shoulder of the lateral liner blocks the collapsible bullnose assembly from passing into the lateral liner;

driving the collapsible guide member into the inwardly facing ramped surface to shear a first shear member that secures the collapsible guide member to the upper ramp in the radially expanded orientation and to shear a second shear member that secures the upper ramp to the mandrel in a secured position, wherein the upper ramp slides axially uphole to a released position in response to the shearing of the second fastener, and wherein the collapsible guide member is actuated to the radially collapsed orientation in response to the upper ramp sliding to the released position and the shearing of the first fastener; and passing the collapsible bullnose assembly into the lateral liner with the collapsible guide member in the radially collapsed orientation.

18. The collapsible bullnose assembly of claim 17, wherein a first outer diameter of the collapsible guide member in the radially expanded orientation is greater than the inner diameter of the no-go shoulder of the lateral liner, and wherein a second outer diameter of the collapsible guide member in the radially collapsed orientation is less than the inner diameter of the no-go shoulder of the lateral liner.

* * * * *